US007835912B2

(12) United States Patent
Zhan et al.

(10) Patent No.: US 7,835,912 B2
(45) **Date of Patent: *Nov. 16, 2010**

(54) SIGNAL PROCESSING METHOD, PROCESSING APPARATUS AND VOICE DECODER

(75) Inventors: Wuzhou Zhan, Shenzhen (CN); Dongqi Wang, Shenzhen (CN); Yongfeng Tu, Shenzhen (CN); Jing Wang, Shenzhen (CN); Qing Zhang, Shenzhen (CN); Lei Miao, Shenzhen (CN); Jianfeng Xu, Shenzhen (CN); Chen Hu, Shenzhen (CN); Yi Yang, Shenzhen (CN); Zhengzhong Du, Shenzhen (CN); Fengyan Qi, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/539,158

(22) Filed: Aug. 11, 2009

(65) Prior Publication Data

US 2009/0292542 A1 Nov. 26, 2009

Related U.S. Application Data

(63) Continuation of application No. 12/264,557, filed on Nov. 4, 2008, now abandoned.

(30) Foreign Application Priority Data

Nov. 5, 2007 (CN) ..... 2007 1 0169616

(51) Int. Cl.
*G10L 13/00* (2006.01)
*G10L 19/00* (2006.01)

(52) U.S. Cl. ..... 704/262; 704/258; 704/219; 704/220

(58) Field of Classification Search ..... 704/214, 704/219–220, 225, 228, 262, 258
See application file for complete search history.

(56) References Cited

U.S. PATENT DOCUMENTS 5,787,430 A 7/1998 Doeringer et al.

(Continued)

FOREIGN PATENT DOCUMENTS

| | | | |
|---|---|---|---|
| CN | 1659625 | A1 | 8/2005 |
| KR | 20070055943 | A1 | 5/2007 |
| WO | WO2005/066937 | | 7/2005 |

OTHER PUBLICATIONS

Chinese office action issued in corresponding Chinese Patent Application No. 200710169616.1; issued Oct. 10, 2008,and English translation thereof.

(Continued)

*Primary Examiner*—Angela A Armstrong

(57) ABSTRACT

The present invention discloses a signal processing method adapted to process a synthesized signal in packet loss concealment. The method includes the following steps: receiving a good frame following a lost frame, obtaining an energy ratio of energy of a signal in the signal of the good frame signal to energy of a synthesized signal corresponding to the same time of the good frame; and adjusting the synthesized signal in accordance with the energy ratio. The present invention also discloses a signal processing apparatus and a voice decoder. Through using the method provided by the present invention, the synthesized signal is adjusted in accordance with the energy ratio of the energy of the first good frame following the lost frame to the energy of the synthesized signal to ensure that there be not a waveform sudden change or an energy sudden change at the place where the lost frame and the first good frame following the lost frame are jointed in the synthesized signal, to realize the waveform's smooth transition and to avoid music noises.

9 Claims, 7 Drawing Sheets

U.S. PATENT DOCUMENTS

| | | | | |
|---|---|---|---|---|
| 5,953,697 | A * | 9/1999 | Lin et al. | 704/225 |
| 6,011,795 | A | 1/2000 | Varghese et al. | |
| 6,665,637 | B2 | 12/2003 | Bruhn | |
| 6,785,687 | B2 | 8/2004 | Baskins et al. | |
| 6,816,856 | B2 | 11/2004 | Baskins et al. | |
| 6,987,821 | B1 | 1/2006 | Li | |
| 7,415,463 | B2 | 8/2008 | Testa | |
| 7,415,472 | B2 | 8/2008 | Testa | |
| 2005/0010402 | A1 | 1/2005 | Sung | |
| 2005/0154584 | A1 * | 7/2005 | Jelinek et al. | 704/219 |
| 2007/0083362 | A1 | 4/2007 | Moriya et al. | |
| 2008/0133517 | A1 | 6/2008 | Kapoor et al. | |
| 2008/0133518 | A1 | 6/2008 | Kapoor et al. | |
| 2008/0154584 | A1 | 6/2008 | Andersen | |
| 2009/0316598 | A1 | 12/2009 | Zhan et al. | |

OTHER PUBLICATIONS

Information Disclosure Statements of the parent U.S. Appl. No. 12/264,557; 3 pages.

Chinese office action issued in corresponding Chinese Patent Application No. 200710169616.1; issued Apr. 17, 2009,and English translation thereof.

European office action issued in corresponding European Patent Application No. 08168256.9; issued Mar. 13, 2009.

European office action issued in corresponding European Patent Application No. 08168256.9; issued Jul. 23, 2009.

Japanese office action issued in corresponding Japanese Patent Application No. 2008-284259 ; issued Apr. 20, 2010.

A low-complexity algorithm for packet loss concealment with G.722; issued Nov. 2006.

Wideband embedded extension for G.711 pulse code modulation; issued Mar. 2008; see 8.4.4.

* cited by examiner

SIGNAL PROCESSING METHOD, PROCESSING APPARATUS AND VOICE DECODER

CROSS-REFERENCE TO RELATED PATENT APPLICATION

This application is a continuation application of a U.S. application Ser. No. 12/264,557, filed Nov. 4, 2008, entitled "SIGNAL PROCESSING METHOD, PROCESSING APPARTUS AND VOICE DECODER," by Wuzhou ZHAN et al., which itself claims the priority from the Chinese patent application No. "200710169616.1" submitted with the State Intellectual Property Office of P.R.C. on Nov. 5, 2007 entitled "METHOD AND APPARATUS FOR SIGNAL PROCESSING", the contents of which are incorporated herein in entirety by reference.

FILED OF THE INVENTION

The present invention relates to signal processing field, and more particularly to a signal processing method, processing apparatus and a voice decoder.

BACKGROUND

In a real-time voice communication system, voice data is required to be transmitted in time and reliably, such as a VoIP (Voice over IP) system. However, because of unreliability of the network system itself, during the transmitting process from a transmitter to a receiver, the data packet may be dropped or can not arrive on the destination in time. The two situations are considered as network packet loss by the receiverer. The network packet loss is unavoidable, and is one of the principal factors influencing the quality of voice communication. Therefore, in the real-time voice communication system, a forceful packet loss concealment method is needed to restore a lost data packet and to get good quality of voice communication under the situation that the network packet loss happens.

In prior real time voice communication technologies, at the transmitter, a coder divides a broadband voice into two sub-bands, a high-band and a low-band, encodes the two sub-bands respectively using Adaptive Differential Pulse Code Modulation (ADPCM), and sends the two encoded sub-bands to the receiver via the network. At the receiver, the two sub-bands are decoded by an ADPCM decoder respectively, and are synthesized to a final signal by a Quadrature Mirror Filter (QMF)

For two different sub-bands, different Packet Loss Concealment (PLC) methods are used. For the low-band signal, when there is no packet loss, a reconstructed signal does not change during cross-fading. When there is packet loss, a short-term predictor and a long-term predictor are used to analyze a past signal (the past signal in the present application means the voice signal before a lost frame), and a voice class information is extracted. And the signal of the lost frame is reconstructed by taking the method for Linear Predictive Coding (LPC) based on pitch repetition, and by using the predictors and the voice class information. The state of the ADPCM should be updated synchronously until a good frame appears. In addition, not only the corresponding signal of the lost frame should be generated, but also a signal for cross-fading should be generated. And once a good frame is received, cross-fading can be executed to the signal of the good frame and the said signal. It should be noted that the cross-fading only happens when a good frame is received after a frame loss by the receiver.

During the process of implementing the present invention, the inventor finds that there exist the following problems in the prior arts: the reconstructed signal of the lost frame is synthesized using the past signal. The waveform and the energy are more similar to the signal in the history buffer, namely the signal before the lost frame, even at the end of the synthesized signal, but not similar to the signal newly decoded. This may cause that a waveform sudden change or an energy sudden change of the synthesized signal occurs at the joint between the lost frame and the first frame following the lost frame. The sudden change is shown in FIG. 1. In FIG. 1, three frames of signals are comprised, which are separated by two vertical lines. The frame N is a lost frame, and the other two frames are good frames. The upper signal is corresponding to an original signal. All of the three data frames are not lost in transmission. And a middle dashed line is corresponding to a signal synthesized by using the frames N−1, N−2 and so on before the frame N. The signal in the downmost row is corresponding to the signal synthesized by employing the prior arts. From FIG. 1, it can be seen that an energy sudden change exists in the transition of the final output signal frame N and the frame N+1, especially at the end of the voice and with longer frames. And repeating the same pitch repetition signal too much can result in music noises.

SUMMARY

Embodiments of the present invention provide a signal processing method adapted to process a synthesized signal in packet loss concealment to make the waveform of a joint between a lost frame and a first frame in the synthesized signal have a smooth transmitting.

The embodiments of the present invention provide a signal processing method adapted to process a synthesized signal in packet loss concealment, including:

receiving a good frame following a lost frame, obtaining an energy ratio of the energy of a signal of the good frame to the energy of a synthesized signal corresponding to the same time of the good frame; and adjusting the synthesized signal in accordance with the energy ratio.

The embodiments of the present invention also provide a signal processing apparatus adapted to process a synthesized signal in packet loss concealment, including:

a detecting module, configured to notify an energy obtaining module when detecting that a frame following a lost frame is a good frame;

the energy obtaining module, configured to obtain an energy ratio of the energy of the signal of the good frame to the energy of the synthesized signal corresponding to the same time of the good frame when receiving the notification sent by the detecting module; and a synthesized signal adjustment module, configured to adjust the synthesized signal in accordance with the energy ratio obtained by the energy obtaining module.

The embodiments of the present invention also provide a voice decoder adapted to decode a voice signal, including a low-band decoding unit, a high-band decoding unit and a quadrature mirror filter unit.

The low-band decoding unit is configured to decode a received low-band decoding signal and compensate a lost low-band signal frame.

The high-band decoding unit is configured to decode received high-band decoding signal and compensate a lost high-band signal frame.

The quadrature mirror filter unit is configured to synthesize the decoded low-band decoding signal and the decoded high-band decoding signal to obtain a final output signal.

The low-band decoding unit includes a low-band decoding sub-unit, a pitch-repetition-based linear predictive coding sub-unit, a signal processing sub-unit and a cross-fading sub-unit.

The low-band decoding sub-unit is configured to decode a received low-band code stream signal.

The pitch-repetition-based linear predictive coding sub-unit is configured to generate a synthesized signal corresponding to a lost frame.

The signal processing sub-unit is configured to receive a good frame following a lost frame, obtain an energy ratio of the energy of the signal of the good frame to the energy of the synthesized signal corresponding to the same time of the good frame, and adjust the synthesized signal in accordance with the energy ratio.

The cross-fading sub-unit is configured to cross-fade the signal decoded by the low-band decoding sub-unit and the signal after energy adjusting by the signal processing sub-unit.

The embodiments of the present invention also provide a computer program product including computer program code. The computer program code can make a computer execute any step in the signal processing method in packet loss concealment when the program code is executed by the computer.

The embodiments of the present invention also provide a computer readable medium storing computer program code. The computer program code can make a computer execute any step in the signal processing method in packet loss concealment when the program code is executed by the computer.

Compared with the prior art, the embodiments of the present invention have the following advantages:

The synthesized signal is adjusted in accordance with the energy ratio of the energy of the first good frame following the lost frame to the energy of the synthesized signal to ensure that there is not a waveform sudden change or an energy sudden change at the place where the lost frame and the first good frame following the lost frame are jointed in the synthesized signal, to realize the waveform's smooth transition and to avoid music noises.

DETAILED DESCRIPTION

Embodiments of the present invention are described in more detail combining with the accompanying drawings.

Figure 1:
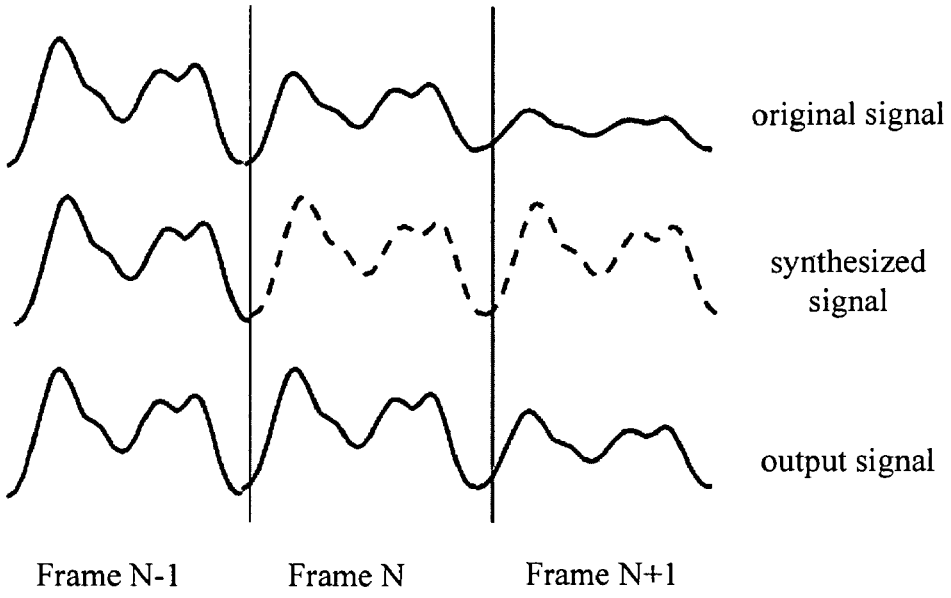
FIG. 1 is a schematic diagram illustrating a sudden change of the waveform or a sudden change of the energy at the place where a lost frame and a first good frame following the lost frame are jointed in the prior art.
Figure 2:
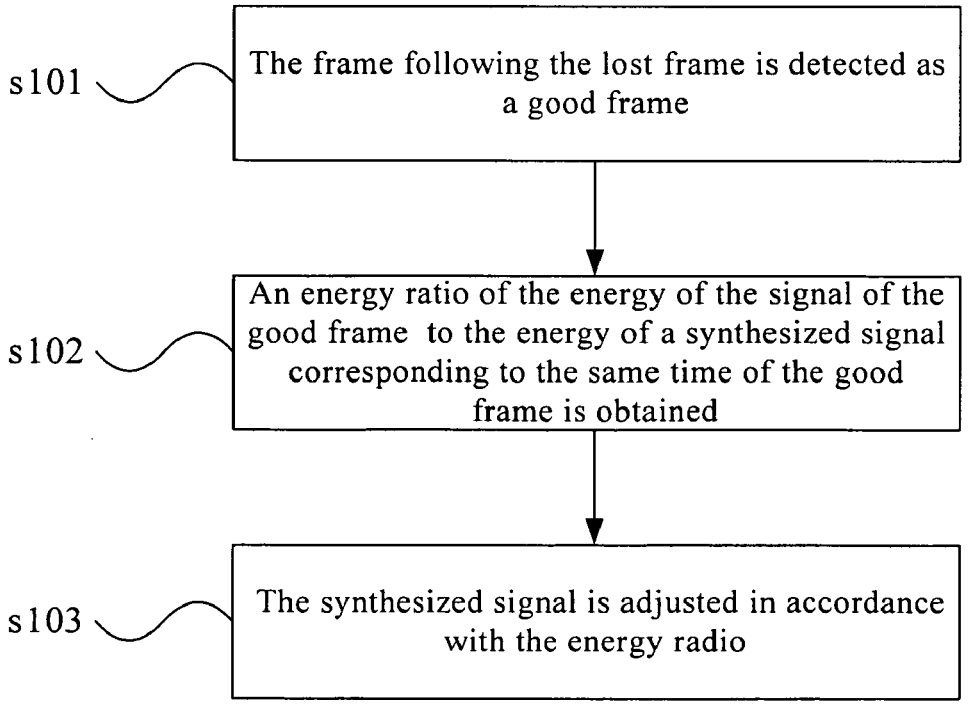
FIG. 2 is a flow chart of a signal processing method in a first embodiment of the present invention.

A first embodiment of the present invention provides a signal processing method adapted to process a synthesized signal in packet loss concealment. As shown in FIG. 2, the method comprises the following steps:

Step s101, a frame following a lost frame is detected as a good frame.

Step s102, an energy ratio of the energy of a signal of the good frame to the energy of the synchronized synthesized signal is obtained.

Step s103, the synthesized signal is adjusted in accordance with the energy ratio.

In the Step s102, the "synchronized synthesized signal" means the synthesized signal corresponding to the same time of the good frame. The "synchronized synthesized signal" that appears in other parts of the present application can be understood in the same way.

The signal processing method in the first embodiment of the present invention is described combining with specific applying cases as follows.

Figure 3:
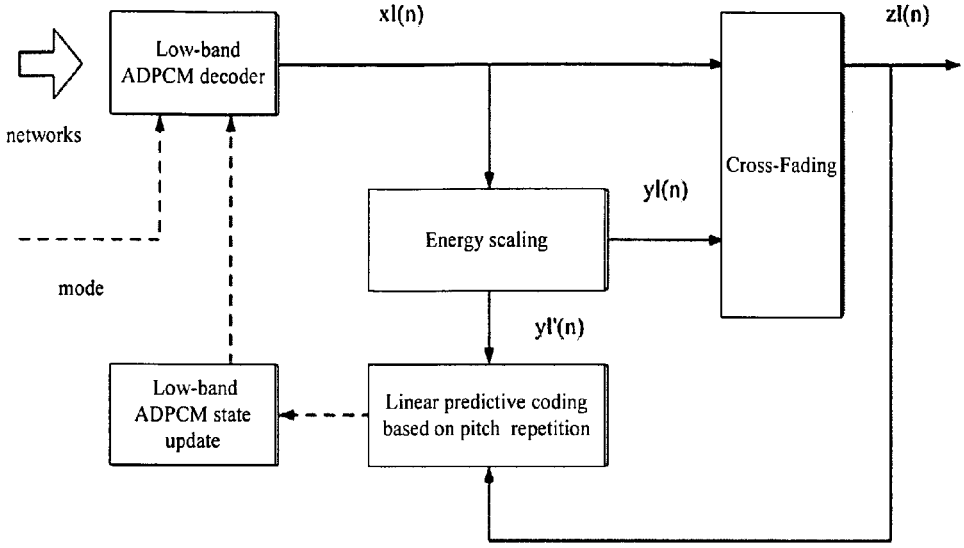
FIG. 3 is a principle schematic diagram of a signal processing method in a first embodiment of the present invention.

In the first embodiment of the present invention, a signal processing method is provided that is adapted to process the synthesized signal in packet loss concealment. The principal schematic diagram is shown in FIG. 3.

In the case that a current frame is not lost, a low-band ADPCM decoder decode the received current frame to obtain a signal xl(n),n=0, . . . , L−1, and an output corresponding to the current frame is zl(n), n=0, . . . , L−1. In this condition, the reconstructed signal is not changed when cross-fading. That is:

$$zl[n]=xl[n],\ n=0,\ldots,L-1$$

wherein the L is the frame length.

In the case of that a current frame is lost, a synthesized signal yl'(n),n=0, . . . L−1 that is corresponding to the current frame is generated by using the method of linear predictive coding based on pitch repetition. According to whether a next frame following the current frame is lost or not, different processing is executed:

When the next frame following the current frame is lost:

Under this condition, an energy scaling processing is not executed for the synthesized signal. The output signal corresponding to the first lost frame zl(n),n=0, . . . , L−1 is the synthesized signal yl'(n),n=0, . . . L−1 that is zl[n]=yl[n]=yl'[n], n=0, . . . , L−1.

When the next frame following the current frame is not lost:

Suppose when the energy scaling is executed, the good frame (that is the next frame following the first lost frame) being used is the good frame xl(n),n=L, . . . , L+M−1, which is obtained after the being decoded by the ADPCM decoder, wherein M is the number of the signal samples when the energy is calculated. The synthesized signal used which is corresponding to the same time of the signal of the good frame is the signal yl'(n),n=L, . . . L+M−1 which is generated by linear predictive coding based on pitch repetition. The yl'(n),n=0, . . . L+N−1 is scaled in energy to obtain the signal yl(n),n=0, . . . L+N−1, which can match the signal xl(n), n=L, . . . L+N−1 in energy, wherein N is the signal length of cross-fading. The output signal zl(n),n=0, . . . L−1 corresponding to the current frame is:

$$zl(n)=yl(n), n=0, \ldots, L-1.$$

The xl(n), n=L, . . . , L+N−1 is updated as the signal zl(n) obtained by the cross-fading of the xl(n),n=L, . . . , L+N−1 and the yl(n),n=L, . . . L+N−1.

Figure 4:
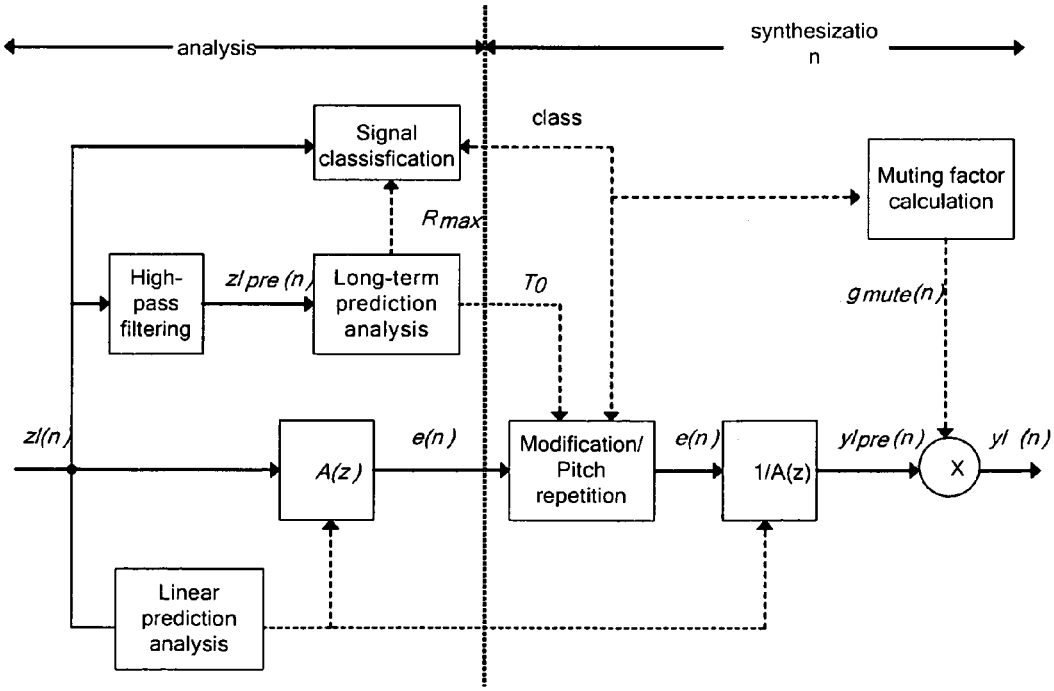
FIG. 4 is a schematic diagram of linear predictive coding module based on pitch repetition.

The method of linear predictive coding based on pitch repetition involved in FIG. 3 is shown in FIG. 4:

Before encountering a lost frame, zl(n) is stored in a buffer for future use, when a frame received is a good frame.

When a first lost frame appears, two steps are required to synthesize the final signal yl'(n). Firstly, the past signal zl(n), n=−Q, . . . −1, is analyzed, and then the signal yl'(n) is synthesized combining with the analysis result, wherein Q is the needed length of the signal when analyzing the past signal.

The module for linear predictive coding based on pitch repetition specifically comprises the following parts:

(1) Linear Prediction (LP) Analysis

The short-term analysis A(z) and synthesis filters 1/A(z) are based on P-order LP filters. The LP analysis filter is defined as:

$$A(z)=1+a_1 z^{-1}+a_2 z^{-2}+\ldots+a_P z^{-P}$$

After the LP analysis of the filter A(z), the residual signal e(n), n=−Q, . . . , −1 corresponding to the past signal zl(n), n=−Q, . . . , −1 is obtained using the following formula:

$$e(n) = zl(n) + \sum_{i=1}^{P} a_i zl(n-i),\ n = -Q, \ldots, -1.$$

(2) Past Signal Analysis

The method for pitch repetition is used for compensating the lost signal. Therefore, a pitch period $T_0$ corresponding to the past signal zl(n),n=−Q, . . . , −1 needs to be estimated. Detail steps are as follows: Firstly, zl(n) are pre-processed to remove a low frequency part which is needless in the Long Term Prediction (LTP) analysis, then the pitch period $T_0$ of the zl(n) could be obtained by LTP analysis; and the voice class could be obtained combining with a signal class module, after that the pitch period $T_0$ is obtained.

The voice classes are shown in table 1:

TABLE 1 the voice classes

| Class Name | Description |
|---|---|
| TRANSIENT | for voice which is transient with large energy variation(e.g. plosives) |
| UNVOICED | for non-voice signals |
| VUV_TRANSITION | corresponding to a transition between voice and non-voice signals |
| WEAKLY_VOICED | the beginning or ending of the voice signals |
| VOICED | voice signals (e.g. steady vowels) |

(3) Pitch Repetition

A pitch repetition module is used for estimating the LP residual signal e(n), n=0, . . . , L−1 corresponding to the lost frame. Before pitch repetition, if the voice class is not VOICED, the magnitude of each sample will be limited by the following formula:

$$e(n) = \min\left(\max_{i=-2,\ \ldots\ ,+2}(|e(n-T_0+i)|), |e(n)|\right) \times \mathrm{sign}(e(n)),$$

$$n = -T_0, \ldots, -1,$$

wherein $$\mathrm{sign}(x) = \begin{cases} 1 & \text{if } x \geq 0 \\ -1 & \text{if } x < 0. \end{cases}$$

If the voice class is VOICED, the residual e(n), n=0. . . . , L−1 corresponding to the lost signal will be obtained by repeating the residual signal corresponding to the last pitch period in a newly received signal of a good frame, that is:

$$e(n)=e(n-T_0).$$

For other voice classes, in order to avoid the periodicity of the generated data being too strong(for the UNVOICED signal, if the periodicity is too strong, it will sound like music noises or other uncomfortable noises), the following formula is used to generate the residual signal e(n), n=0, . . . , L−1 corresponding to the lost signal:

$$e(n)=e(n-T_0+(-1)^n).$$

Besides generating the residual signal corresponding to the lost frame, in order to ensure a smooth joint between the lost frame and the first good frame following the lost frame, the residual signal e(n), n=L, . . . , L+N−1, of additional N sample will be generated continually to generate a signal for cross-fading.

(4) LP Synthesis

After generating the residual signal e(n) corresponding to the lost frame and the signal for cross-fading, the reconstructed signal of the lost frame is given by:

$$yl_{pre}(n) = e(n) - \sum_{i=1}^{8} a_i yl(n-i)$$

wherein e(n), n=0, . . . , L−1, is the residual signal obtained in the pitch repetition. In addition, N samples of $yl_{pre}(n)$, n=L, . . . , L+N−1 are generated using the above formula; these samples are used for cross-fading.

(5) Adaptive Muting

The energy of the $yl_{pre}(n)$ is controlled according to different voice classes provided in Table 1. That is:

$$yl'(n)=g_{mute}(n)\times yl_{pre}(n), n=0, \ldots, L+M-1, g_{mute}(n)\in[0\ 1]$$

where $g_{mute}(n)$ corresponds to a muting factor corresponding to each sample. The value of $g_{mute}(n)$ changes in accordance with different voice classes and the situation of the packet loss. An example is given as follows:

For those voices with large energy variation, for example plosives, corresponding to the voice with TRANSIENT class and VUV_TRANSITION class in Table 1, the speed for fading may be a little high. For those voices with small energy variation, the speed for fading may be a little low. To describe conveniently, it is assumed that a signal of 1 ms includes R samples.

Specifically, for the voice with TRANSIENT class, within 10 ms (totally S=10*R samples), making $g_{mute}(-1)$, $g_{mute}(n)$ fades from 1 to 0. $g_{mute}(n)$ corresponding to samples after 10 ms is 0, which can be shown using a formula as:

$$g_{mute}(n)=\begin{cases} g_{mute}(n-1)-\dfrac{n+1}{S+1} & n=0, \ldots, S-1 \\ 0 & n\geq S. \end{cases}$$

For the voice with VUV_TRANSITION class, the fading speed within the initial 10 ms may be a little low, and the voice fades to 0 quickly within the following 10 ms, which can be shown using formula as:

$$g_{mute}(n)=\begin{cases} g_{mute}(n-1)-\dfrac{0.024\cdot(n+1)}{S+1} & n=0, \ldots, S-1 \\ g_{mute}(n-1)-\dfrac{g_{mute}(S-1)\cdot(n+1-S)}{S+1} & n=S, \ldots, 2S-1 \\ 0 & n\geq 2S. \end{cases}$$

For the voice of other classes, the fading speed within the initial 10 ms may be a little low, the fading speed within the following 10 ms may be a little higher, and the voice fades to 0 quickly within the following 20 ms, which can be shown using formula as below:

$$g_{mute}(m)=\begin{cases} g_{mute}(n-1)-\dfrac{0.024\cdot(n+1)}{S+1} & n=0, \ldots, S-1 \\ g_{mute}(n-1)-\dfrac{0.048\cdot(n+1-S)}{S+1} & n=S, \ldots, 2S-1 \\ g_{mute}(2\cdot S-1) & \\ g_{mute}(n-1)-\dfrac{(n+1-2\cdot S)}{2S+1} & n=2S, \ldots, 4S-1 \\ 0 & n\geq 4S. \end{cases}$$

The energy scaling in FIG. 3 is that:

The detailed method for executing energy scaling to yl'(n), n=0, . . . , L+N−1 according to xl(n),n=L, . . . , L+M−1 and yl'(n),n=L, . . . , L+M−1 includes the following steps, referring to FIG. 3.

Step s201, an energy $E_1$ corresponding to the synthesized signal yl'(n),n=L, . . . L+M−1 and an energy $E_2$ corresponding to the signal xl(n),n=L, . . . , L+M−1 are calculated respectively.

Concretely, $$E_1=\sum_{i=L}^{L+M-1} yl'^2(i) \quad \text{and} \quad E_2=\sum_{i=L}^{L+M-1} xl^2(i)$$

where M is the number of the signal samples when the energy is calculated. The value of M could be set flexibly according to specific cases. For example, under the circumstances that the frame length being a little short, such as the frame length L being shorter than 5 ms, M=L is recommended; under the circumstances that the frame length is a little long and the pitch period is shorter than one frame length, M could be set as a corresponding length of one pitch period signal.

Step s202, the energy ratio R of $E_1$ to $E_2$ is calculated.

Concretely, $$R=\text{sign}(E_1-E_2)\sqrt{\frac{|E_1-E_2|}{E_1}},$$

where the function sign( ) is a symbolic function, and it is defined as follows:

$$\text{sign}(x)=\begin{cases} 1 & \text{if } x\geq 0 \\ -1 & \text{if } x<0. \end{cases}$$

Step s203, the magnitude of the signal yl'(n),n=0, . . . L+N−1 is adjusted in accordance with the energy ratio R.

Concretely, $$yl(n)=yl'(n)*\left(1-\frac{R}{L+N}*n\right)$$
$$n=0, \ldots, L+N-1,$$

where N is a length used for cross-fading by the current frame. The value of N could be set flexibly according to specific cases. Under this circumstance that the frame length is a little short, N could be set as the length of one frame, that is N=L.

In order to avoid appearing the circumstance of energy magnitude overflowing (the energy magnitude exceeds the allowable maximum value of the corresponding magnitudes of the samples) when $E_1<E_2$ using the above method, the above formula is only used to fade the signal yl'(n),n=0, . . . L+N−1 when $E_1>E_2$.

When the previous frame is a lost frame and the current frame is also a lost frame, the energy scaling need not be executed to the previous frame, that is the yl(n) corresponding to the previous frame is:

$$yl(n)=yl'(n)\ n=0, \ldots, L-1.$$

The cross-fading in FIG. 3 concretely is:

In order to realize a smooth energy transition, after that yl(n),n=0, . . . L+N−1 is generated through executing energy scaling by the synthesized signal yl'(n),n=0, . . . L+N−1, the low-band signals need to be processed by cross-fading. The rule is shown in Table 2.

TABLE 2

| the rule of cross-fading | | | |
|---|---|---|---|
| | | current frame | |
| | | lost frame | good frame |
| previous frame | lost frame | $zl(n) = yl(n)$, $n = 0, \ldots, L-1$ | $zl(n) = \frac{n}{N-1}xl(n) + \left(1 - \frac{n}{N-1}\right)yl(n)$, $n = 0, \ldots, N-1$ and $zl(n) = xl(n)$, $n = N, \ldots, L-1$ |
| | good frame | $zl(n) = yl(n)$, $n = 0, \ldots, L-1$ | $zl(n) = xl(n)$, $n = 0, \ldots, L-1$ |

In the Table 2, zl(n) is the signal which corresponds to the signal corresponding to the current frame outputted finally. xl(n) is the signal of the good frame corresponding to the current frame. yl(n) is a synthesized signal at the same time corresponding to the current frame.

Figure 5:
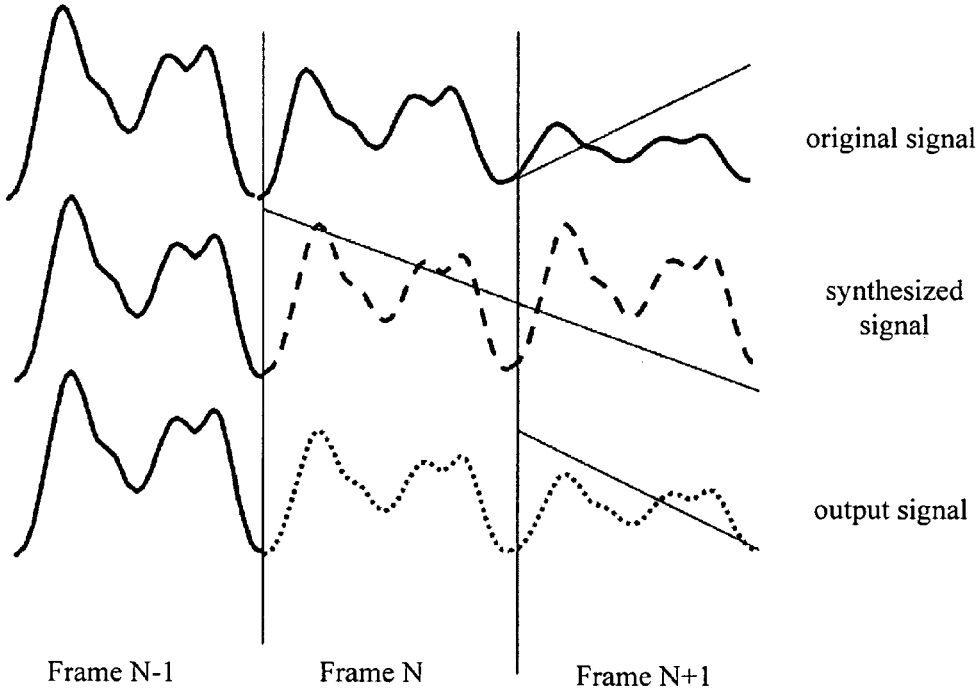
FIG. 5 is a schematic diagram of different signals in a first embodiment of the present invention.

The schematic diagram of the above processes is shown in FIG. 5.

The first row is an original signal. The second row is the synthesized signal shown as a dashed line. The downmost row is an output signal shown as a dotted line, which is the signal after energy adjustment. The frame N is a lost frame, and the frame N−1 and N+1 are both good frames. Firstly, the energy ratio of the energy of the received signal of frame N+1 to the energy of the synthesized signal corresponding to the frame N+1 is calculated, and then the synthesized signal fades in accordance with the energy ratio, to obtain the output signal in the downmost row. The method for fading may refer to the above step s203. The processing of cross-fading is executed at last. For the frame N, an output signal after fading of the frame N is taken as the output of the frame N (it is supposed herein that the output of the signal is allowed to have at least a delay of one frame, that is, the frame N could be outputted after that the frame N+1 is inputted). For the frame N+1, according to the principle of cross-fading, the output signal of the frame N+1 after fading with a descent window multiplied by, is superposed on the received original signal of the frame N+1 with a ascent window multiplied by. The signal obtained by superposing is taken as the output of the frame N+1.

In a second embodiment of the present invention, a signal processing method is provided which is adapted to process the synthesized signal in packet loss concealment. The difference between the processing methods of the first embodiment and the second embodiment is that in the above first embodiment, when the method based on the pitch period is used to synthesize the signal yl'(n), the status of phase discontinuousness may occur, as shown in FIG. 6.

Figure 6:
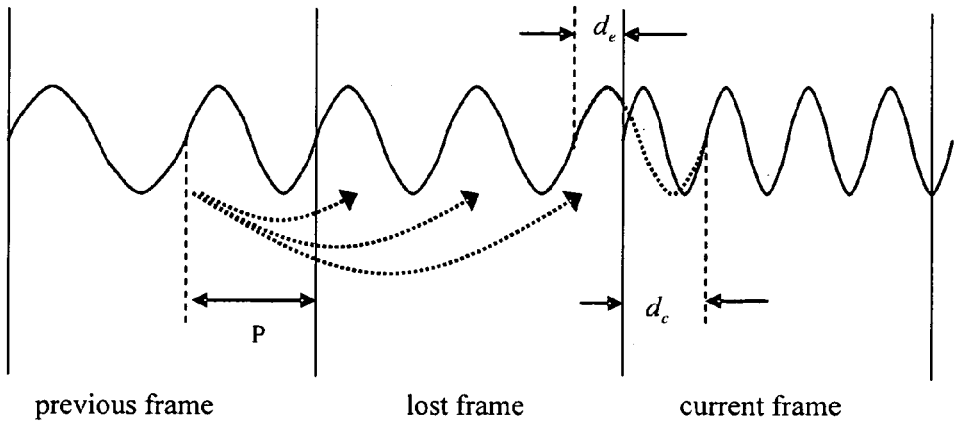
FIG. 6 is a schematic diagram illustrating a situation of phase discontinuousness happening when a method based on pitch repetition is used to synthesize a signal in a second embodiment of the present invention.

As shown in FIG. 6, the signal between two vertical solid lines corresponds to one frame of signal. Because the diversity and variation of the human voice, the pitch period corresponding to the voice cannot keep unchanged and is constantly changing. Therefore, when the last pitch period of the past signal is used repeatedly to synthesize the signal of the lost frame, the situation that the waveform between the end of the synthesized signal and the beginning of the current frame is discontinuous will happen. The waveform has a sudden change, namely the situation of phase mismatching. It can be seen from FIG. 6, the distance that from the beginning point of the current frame to the left minimum distance matching points of the synthesized signal is $d_e$, and the distance that from the beginning point of the current frame to the right minimum distance matching points of the synthesized signal is $d_e$. In the prior art, a method for realizing phase matching by executing an interpolation to the synthesized signal is provided. For example, the corresponding phase separation d is $-d_e$ when the frame length is L (if the optimum matching point is on the left of the beginning point of current frame, and the distance between the optimum point and the beginning point of the current frame is $d_e$, then $d=-d_e$; if the optimum matching point is on the right of the beginning point of the current frame, and the distance between the optimum point and the beginning point of the current frame is $d_c$, then $d=d_c$). And then the signal of L+d samples is interpolated to generate the signal of N samples by the interpolation method.

Figure 7:
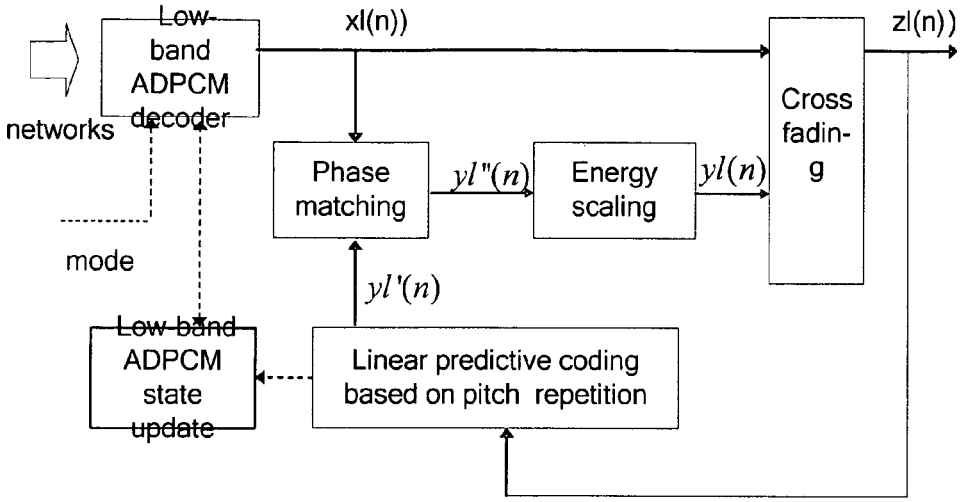
FIG. 7 is a principle schematic diagram of a signal processing method in a second embodiment of the present invention.

The signal is synthesized based on pitch repetition in FIG. 6, therefore the situation of phase mismatching also happens inevitably. In order to avoid the situation, a method is provided and the principle schematic diagram is shown in FIG. 7. The difference between this embodiment and the first embodiment is that the energy scaling processing can be executed after executing phase matching to the linear predictive coding signal based on pitch repetition. Phase matching is executed to the signal yl'(n), n=0, . . . , L+N−1 before energy scaling. For example, an interpolated signal yl"(n), n=0, . . . , L+N−1 may be obtained executing interpolating on the yl'(n), n=0, . . . , L+N−1, using the above interpolation method, and the signal yl(n) can be obtained by executing energy scaling to the yl"(n) combining with the signal xl(n) and the signal yl"(n). Finally, the step of cross-fading is the same with the step in the first embodiment.

Through using the signal processing method provided by the embodiments of the present invention, the synthesized signal is adjusted in accordance with the energy ratio of the energy of the first good frame following the lost frame to the energy of the synthesized signal to ensure that there is not a waveform sudden change or an energy sudden change at the place where the lost frame and the first frame following the lost frame are jointed for the synthesized signal, which realizes the waveform's smooth transiting and to avoid music noises.

Figure 8:
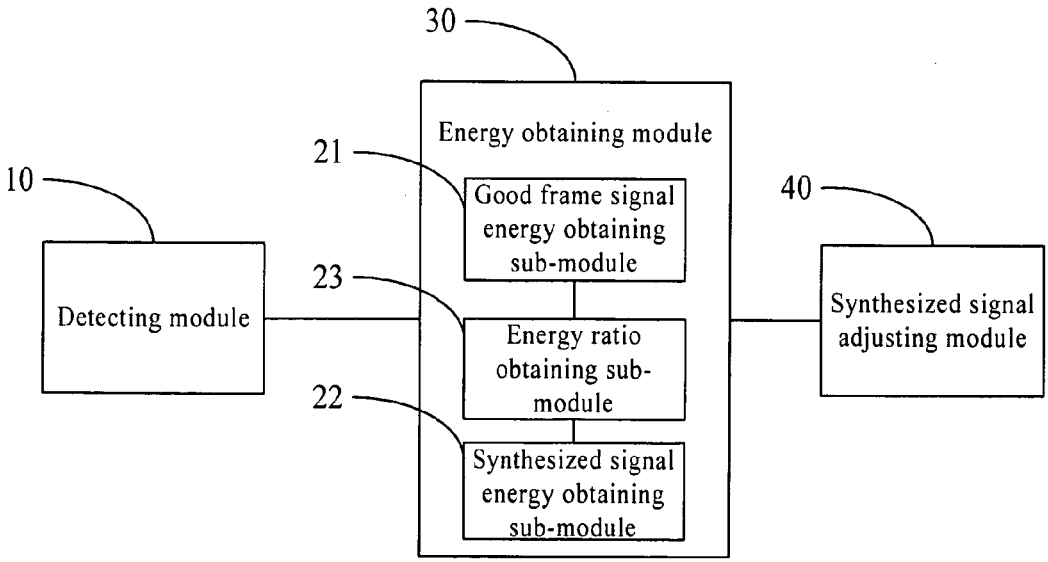
FIG. 8 is a schematic structural diagram of a first apparatus for signal processing in a third embodiment of the present invention.

A third embodiment of the present invention also provides an apparatus for signal processing which is adapted to process the synthesized signal in packet loss concealment. The structure schematic diagram is shown in FIG. 8. The apparatus includes:

a detecting module 10, configured to notify an energy obtaining module 30 when detecting a next frame following a lost frame is a good frame;

the energy obtaining module 30, configured to obtain an energy ratio of the energy of the good frame signal to the energy of the synchronized synthesized signal when receiving the notification sent by the detecting module 10;

a synthesized signal adjustment module 40, configured to adjust the synthesized signal in accordance with the energy ratio obtained by the energy obtaining module 30.

Concretely, the energy obtaining module 30 further includes:

a good frame signal energy obtaining sub-module 21, configured to obtain the energy of the good frame signal;

a synthesized signal energy obtaining sub-module 22, configured to obtain the energy of the synthesized signal; and an energy ratio obtaining sub-module 23, configured to obtain the energy ratio of the energy of the good frame signal to the energy of the synchronized synthesized signal.

Figure 9:
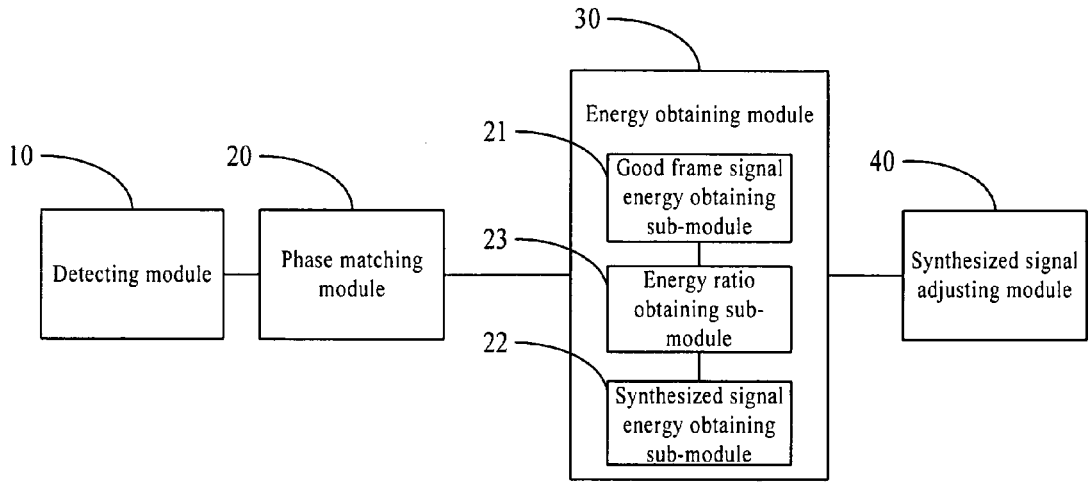
FIG. 9 is a schematic structural diagram of a second apparatus for signal processing in a third embodiment of the present invention.

In addition, the apparatus for signal processing also comprises:

a phase matching module 20, configured to execute phase matching to the synthesized signal inputted and send the synthesized signal after phase matching to the energy obtaining module 30, shown in FIG. 9, as a second apparatus for signal processing provided by the third embodiment of the invention.

Figure 10:
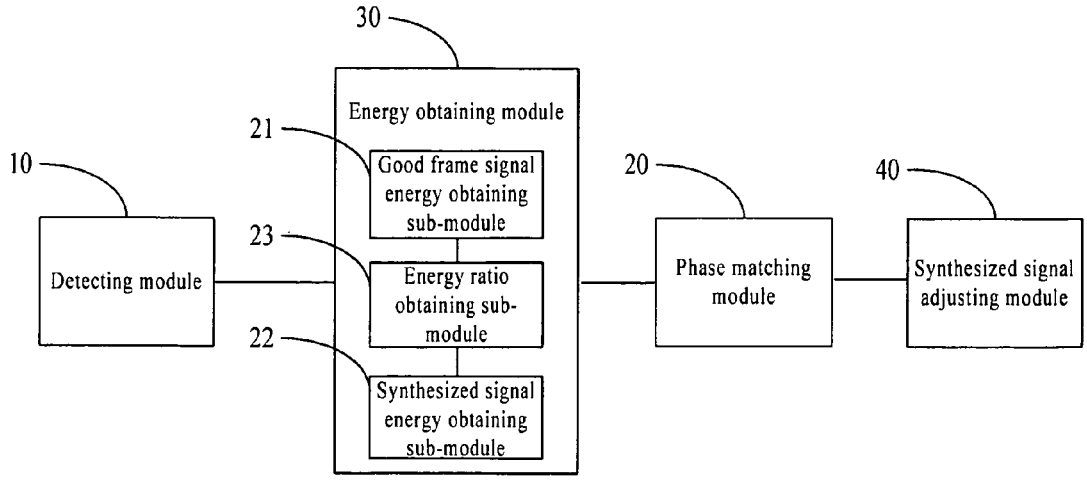
FIG. 10 is a schematic structural diagram of a third apparatus for signal processing in a third embodiment of the present invention.

Furthermore, as shown in FIG. 10, the phase matching module 20 also can be set between the energy obtaining module 30 and the synthesized signal adjustment module 40, configured to obtain the energy ratio of the energy of the good frame signal to the energy of the synthesized signal corresponding to the same time of the good frame and execute phase matching to a signal inputted to the phase matching module 20 and send the signal after phase matching to the synthesized signal adjustment module 40.

Figure 11:
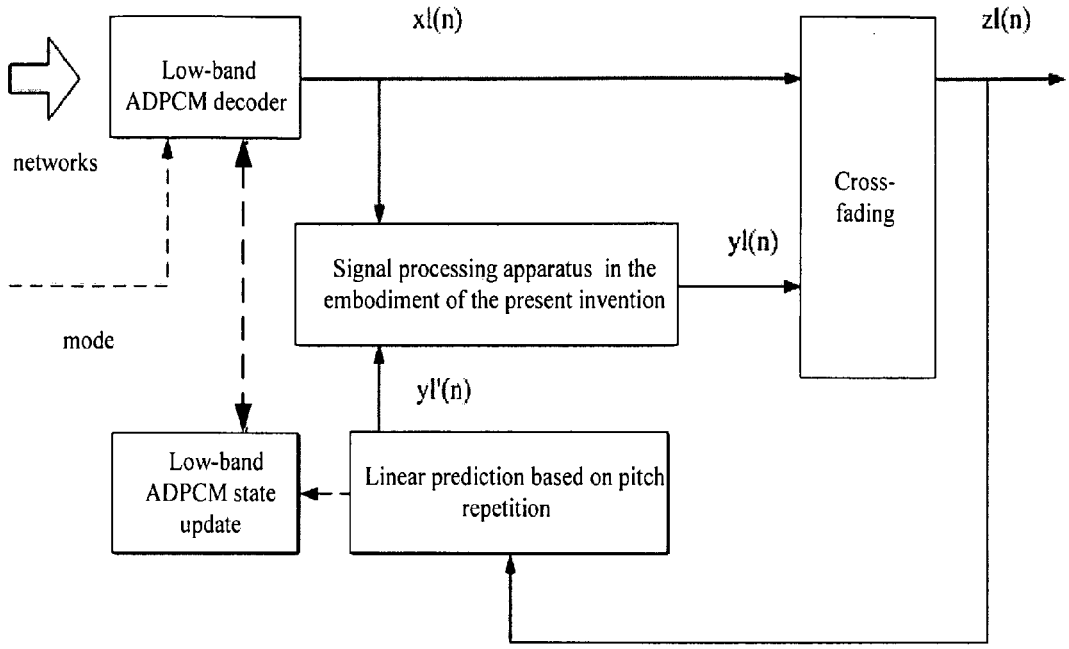
FIG. 11 is a schematic diagram illustrating an applying case of a processing apparatus in a third embodiment of the present invention.

A specific applying case of the processing apparatus in the third embodiment of the present invention is shown in FIG. 11. In the case of that a current frame is not lost, a low-band ADPCM decoder decodes the received current frame to obtain a signal xl(n),n=0, . . . , L−1, and an output corresponding to the current frame is zl(n),n=0, . . . , L−1. In this condition, the reconstruction signal is not changed when cross-fading. That is:

$$zl[n]=xl[n],\ n=0,\ldots,L-1$$

where L is the frame length.

In the case that the current frame is lost, a synthesized signal yl'(n),n=0, . . . L−1 that is corresponding to the current frame is generated by using the method of linear predictive coding based on pitch repetition. According to whether a next frame following the current is lost or not, different processing is executed:

When the next frame following the current frame is lost:

In this condition, the apparatus for signal processing in the embodiments of the invention does not process the synthesized signal yl'(n),n=0, . . . L−1. The output signal zl(n), n=0, . . . , L−1 corresponding to a first lost frame is the synthesized signal yl'(n),n=0, . . . L−1 that is zl[n]=yl[n]=yl'[n], n=0, . . . , L−1.

When the next frame following the current frame is not lost:

When the synthesized signal yl'(n),n=0, . . . L+N−1 is processed by using the apparatus for signal processing in the embodiments of the invention, the good frame (that is the next frame following the first lost frame) being used is the good frame xl(n),n=L, . . . , L+M−1 obtained after the decoding of the ADPCM decoder, wherein M is the number of the signal samples when calculating the energy. The synthesized signal being used which is corresponding to the same time of the good signal is the signal yl'(n),n=L, . . . L+M−1 which is generated by linear predictive coding based on pitch repetition. The yl'(n),n=0, . . . L+N−1 is processed to obtain the signal yl(n),n=0, . . . L+N−1, which can match the signal xl(n),n=L, . . . , L+N−1 in energy, wherein N is the signal length for executing cross-fading. The output signal zl(n), n=0, . . . , L−1 corresponding to the current frame is:

$$zl(n)=yl(n),n=0,\ldots,L-1.$$

xl(n),n=L, . . . , L+N−1 is updated to the signal zl(n), which is obtained by the cross-fading of the xl(n),n=L, . . . , L+N−1 and the yl(n),n=L, . . . L+N−1.

Through using the apparatus for signal processing provided by the embodiments of the present invention, the synthesized signal is adjusted in accordance with the energy ratio of the energy of the first good frame following the lost frame to the energy of the synthesized signal to ensure that there is not a waveform sudden change or an energy sudden change at the place where the lost frame and the first frame following the lost frame are jointed for the synthesized signal, which realizes the waveform's smooth transition and to avoid music noises.

Figure 12:
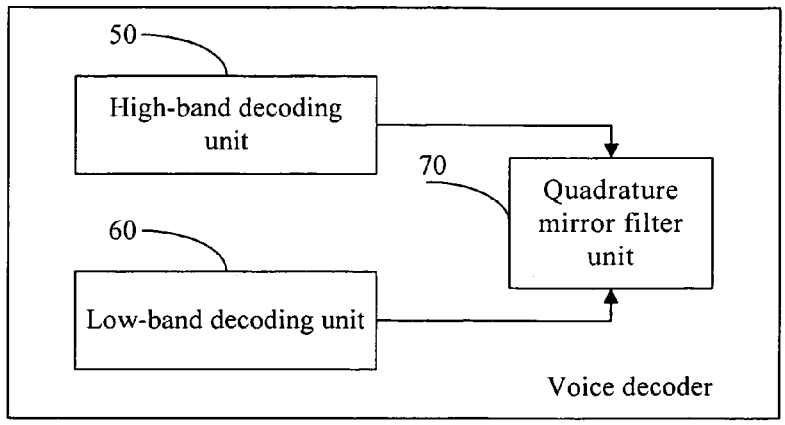
FIG. 12 is a module schematic diagram of a voice decoder in a fourth embodiment of the present invention.

A fourth embodiment of the present invention provides a voice decoder, as shown in FIG. 12, including a high-band decoding unit 50 configured to decode a received high-band decoding signal and compensate a lost high-band signal frame; a low-band decoding unit 60 configured to decode a received low-band decoding signal and compensate a lost low-band signal frame; a quadrature mirror filter unit 70 configured to synthesize a low-band decoded signal and a high-band decoded signal to obtain a final output signal. The high-band decoding unit 50 decodes the received high-band code stream signal and synthesizes the lost high-band signal frame. The low-band decoding unit 60 decodes the received low-band code stream signal and synthesizes the lost low-band signal frame. The quadrature mirror filter unit 70 synthesizes the low-band decoded signal outputted from the low-band decoding unit 60 and the high-band decoded signal outputted from the high-band decoding unit 50, to obtain a final decoded signal.

Figure 13:
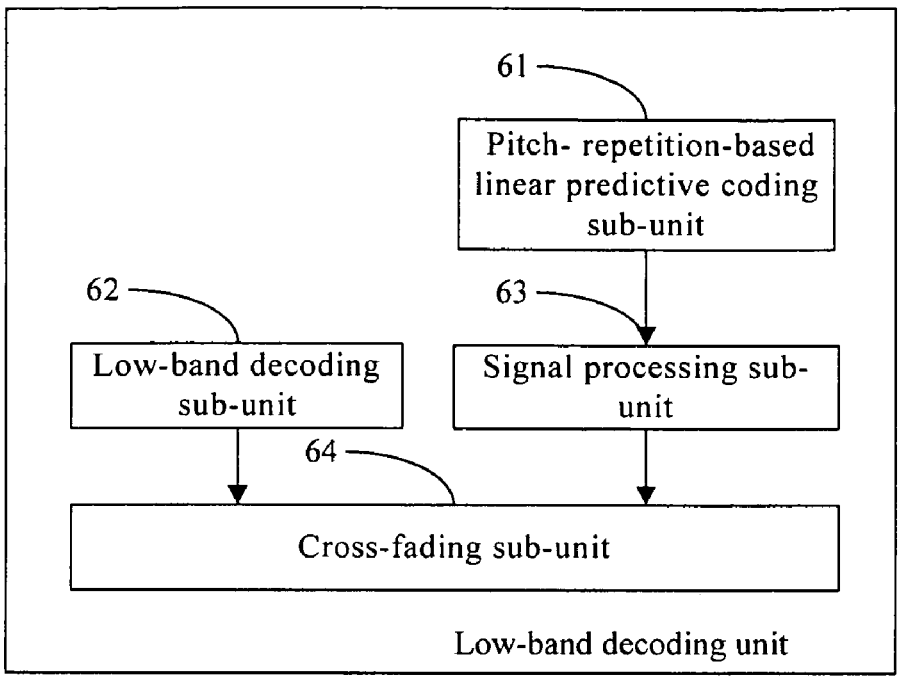
FIG. 13 is a module schematic diagram of a low-band decoding unit of a voice decoder in a fourth embodiment of the present invention.

For the low-band decoding unit 60, as shown in FIG. 13, specifically includes following modules: a pitch-repetition-based linear predictive coding sub-unit 61 configured to generate a synthesized signal corresponding to a lost frame; a low-band decoding sub-unit 62 configured to decode a received low-band code stream signal; a signal processing sub-unit 63 configured to adjust the synthesized signal; a cross-fading sub-unit 64 configured to cross-fade the signal decoded by the low-band decoding sub-unit and the signal adjusted by the signal processing sub-unit 63.

The low-band decoding sub-unit 62 decodes a received low-band signal. The pitch-repetition-based linear predictive coding sub-unit 61 obtains a synthesized signal by linear predictive coding to the lost low-band signal frame. The signal processing sub-unit 63 adjusts the synthesized signal to make the energy magnitude of the synthesized signal consistent with the energy magnitude of the decoded signal processed by the low-band decoding sub-unit 62, and to avoid the appearance of music noises. The cross-fading sub-unit 64 cross-fades the decoded signal processed by the low-band decoding sub-unit 62 and the synthesized signal adjusted by the signal processing sub-unit 63 to obtain the final decoded signal after lost frame compensation.

The structure of the signal processing sub-unit 63 has three different forms corresponding to schematic structural diagrams of the signal processing apparatus shown in FIG. 8 to FIG. 10, and detailed description is omitted.

Through description of above embodiments, the skilled person in the art could clearly understand that the present invention could be accomplished by using software and required general hardware platform, or by hardware, but the former is a better embodiment in many cases. Based on such understanding, the substantial matter in the technical solution of the present invention or the part contributing to the prior art could be realized in form of software products. The software products of the computer is stored in a storage medium and they comprise a number of instructions for making an apparatus execute the method described in each embodiment of the present invention.

Though illustration and description of the present disclosure have been given combining with preferred embodiments thereof, it should be appreciated by persons of ordinary skill in the art that various changes in forms and details can be made without deviation from the spirit and scope of this disclosure, which are defined by the appended claims.

What is claimed is:

1. A signal processing method in packet loss concealment, comprising:

receiving a good frame following a lost frame, obtaining an energy ratio R of energy of a signal of the good frame to energy of a synthesized signal corresponding to the same time of the good frame; and adjusting the synthesized signal in accordance with the energy ratio;

wherein the synthesized signal is generated over at least the lost frame and the good frame following the lost frame;

wherein the energy ratio R of energy of the signal of the good frame to energy of the synthesized signal corresponding to the same time of the good frame is:

$$R = \text{sign}(E_1 - E_2)\sqrt{\frac{|E_1 - E_2|}{E_1}}$$

where sign( )is a symbolic function, $E_1$ is the energy of the synthesized signal corresponding to the same time of the good frame, and $E_2$ is the energy of the signal of the good frame;

wherein the synthesized signal is adjusted in accordance with the following formula:

$$yl(n) = yl'(n) * \left(1 - \frac{R}{L+N} * n\right)$$
$$n = 0, \ldots, L+N-1,$$

wherein L is the frame length, N is the length of the signal required for cross-fading, yl' (n) is the synthesized signal before adjusting, and yl(n) is the synthesized signal after adjusting.

2. The signal processing method according to claim 1, wherein the synthesized signal is a synthesized signal generated by linear predictive coding based on pitch repetition.

3. The signal processing method according to claim 1, after obtaining the energy ratio of energy of a signal of the good frame to energy of the synthesized signal corresponding to the same time of the good frame, further comprising:

determining that the energy of the signal of the good frame is less than the energy of the synthesized signal corresponding to the same time of the good frame, and adjusting the synthesized signal in accordance with the energy ratio.

4. The signal processing method according to claim 1, before adjusting the synthesized signal in accordance with the energy ratio, further comprising:

executing phase matching to the synthesized signal.

5. The signal processing method according to claim 1, after the adjusting the synthesized signal in accordance with the energy ratio, further comprising:

cross-fading the signal of the good frame and the synthesized signal corresponding to the same time of the good frame, and obtaining an output signal corresponding to the same time of the good frame.

6. A computer readable medium storing computer program code, wherein the computer program code, when executed by a computer, causes the computer to perform the processes as follows:

receiving a good frame following a lost frame, obtaining an energy ratio R of energy of a signal of the good frame to energy of a synthesized signal corresponding to the same time of the good frame; and adjusting the synthesized signal in accordance with the energy ratio;

wherein the synthesized signal is generated over at least the lost frame and the good frame following the lost frame;

wherein the energy ratio R of energy of the signal of the good frame to energy of the synthesized signal corresponding to the same time of the good frame is:

$$R = \text{sign}(E_1 - E_2)\sqrt{\frac{|E_1 - E_2|}{E_1}}$$

where sign( )is a symbolic function, $E_1$ is the energy of the synthesized signal corresponding to the same time of the good frame, and $E_2$ is the energy of the signal of the good frame;

wherein the synthesized signal is adjusted in accordance with the following formula:

$$yl(n) = yl'(n) * \left(1 - \frac{R}{L+N} * n\right)$$
$$n = 0, \ldots, L+N-1,$$

wherein L is the frame length, N is the length of the signal required for cross-fading, yl'(n) is the synthesized signal before adjusting, and yl(n) is the synthesized signal after adjusting.

7. The computer readable medium according to claim 6, after obtaining the energy ratio of energy of a signal of the good frame to energy of the synthesized signal corresponding to the same time of the good frame, further comprising:

determining that the energy of the signal of the good frame is less than the energy of the synthesized signal corresponding to the same time of the good frame, and adjusting the synthesized signal in accordance with the energy ratio.

8. The computer readable medium according to claim 6, before adjusting the synthesized signal in accordance with the energy ratio, further comprising:

executing phase matching to the synthesized signal.

9. The computer readable medium according to claim 6, after the adjusting the synthesized signal in accordance with the energy ratio, further comprising:

cross-fading the signal of the good frame and the synthesized signal corresponding to the same time of the good frame, and obtaining an output signal corresponding to the same time of the good frame.

* * * * *